United States Patent [19]

Jay

[11] 4,102,545

[45] Jul. 25, 1978

[54] SLIDING DOOR LOCKING SYSTEM

[75] Inventor: Melvin C. Jay, Streamwood, Ill.

[73] Assignee: Elgin-Macor, Inc., Elgin, Ill.

[21] Appl. No.: 771,612

[22] Filed: Feb. 22, 1977

[51] Int. Cl.[2] ..... E05C 5/02; E05D 13/06

[52] U.S. Cl. ..... 292/57; 49/450; 292/147; 292/288; 292/DIG. 47

[58] Field of Search ..... 292/57, 58, 59, 60, 292/61, 62, 147, 288, DIG. 46, DIG. 47, 4, 149, 241, 251; 49/449, 450; 70/100

[56] References Cited

U.S. PATENT DOCUMENTS

| | | | |
|---|---|---|---|
| 74,718 | 2/1868 | Piersons | 292/57 |
| 368,595 | 8/1887 | King | 292/57 X |
| 447,068 | 2/1891 | Dixon | 292/57 |
| 579,246 | 3/1897 | Wallenstein | 292/61 |
| 698,742 | 4/1902 | Scharnweber | 292/57 |
| 769,374 | 9/1904 | Berry | 292/57 |
| 1,244,725 | 10/1917 | Gadke | 292/60 |
| 1,622,791 | 3/1927 | Lang | 292/57 |
| 1,760,398 | 5/1930 | Coleman | 292/241 X |
| 2,735,707 | 2/1956 | Sylvan | 292/241 X |
| 3,869,887 | 3/1975 | Zeit | 70/100 |
| 3,930,678 | 1/1976 | Alexander | 292/DIG. 46 X |

FOREIGN PATENT DOCUMENTS

| | | | |
|---|---|---|---|
| 206,533 | 12/1955 | Australia | 292/57 |
| A34,638 | 3/1929 | France | 292/251 |
| 2,387 of | 1890 | United Kingdom | 292/147 |
| 2,275 of | 1893 | United Kingdom | 292/57 |
| 173,910 | 1/1922 | United Kingdom | 292/57 |

*Primary Examiner*—Roy D. Frazier
*Assistant Examiner*—Thomas J. Holke
*Attorney, Agent, or Firm*—Dressler, Goldsmith, Clement, Gordon & Shore, Ltd.

[57] ABSTRACT

A safe and tamper-resistant lock assembly for sliding glass doors and the like for securely locking a slidable door in a closed or partially opened position. The lock assembly includes a specially configured bracket which is mounted upon the stationary frame assembly of the door unit. The bracket has an inverted J-shaped channel and an elongated wall defining a plurality of apertures including one aperture which is positioned to overlie an aperture in the slidable frame of the door when the door is in a closed position and another aperture which is positioned to overlie the aperture in the slidable frame when the door is in a partially opened position. A specially configured locking key is provided with a cylindrical shank having an arcuate locking cam for lockably engaging the inverted J-shaped channel of the bracket when the shank is inserted into the aperture in the slidable frame and into one of the apertures in the bracket. Desirably, a specially designed impact-resistant grommet is provided for snap-fitting engagement into the aperture in the slidable frame of the door.

11 Claims, 5 Drawing Figures

SLIDING DOOR LOCKING SYSTEM

BACKGROUND OF THE INVENTION

This invention relates to door locking systems, and more particularly, to a lock assembly for use in slidable doors and the like.

Slidable doors and particularly transparent slidable doors are very useful in a variety of environments, such as to provide a readily accessible and removable "see-through" closure between the family room or other room of a house or apartment and an outside patio, swimming pool, yard or balcony. The "transparent" characteristics of transparent slidable doors generally permit residents of the household to comfortably sit in their family room and watch their children play on their patio or in their swimming pool and generally observe whatever is happening outside that portion of the house. The transparent characteristics of such doors also permit the residents of the house to comfortably sit or work in their back yard or balcony and observe their children or whatever else is happening in the family room.

The "slidable" feature of such door units permit sliding of the doors from a closed position to an open position, usually with minimal effort, to provide easy ingress and egress between the family room and yard or balcony. The slidable doors can also be partially opened to allow circulation and passage of air through the screen door or opening of the door unit into the house.

Very often such slidable door units are equipped with conventional latching mechanisms which can often be easily pried open or jarred by intruders when the residents of the household are away. Furthermore, such conventional latching mechanisms typically do not permit the slidable door to be securely locked when the slidable door is partially opened which would desirably allow circulation and passage of air into the house through the door units when the residents of the household are away from home.

It is therefore very desirable to provide a lock assembly for sliding doors and the like which obviates the above disadvantages and which is substantially safe, secure and tamper-proof.

SUMMARY OF THE INVENTION

A new and improved sliding door locking system is provided for safely and securely locking a slidable door or the like in both a closed and a partially opened position.

The sliding door locking system includes a sliding door assembly having a stationary door frame assembly with tracks thereon. A slidable door is provided with a panel, such as a light-transmissive glass-like panel, and a slidable frame member which peripherally bounds and secures the panel. The slidable frame has a first aperture therein and includes means, such as rollers, for slidably engaging the tracks of the stationary door frame assembly to permit movement of the slidable door from a closed position for substantially preventing passage of pedestrian traffic through the sliding door assembly, to a partially opened position for permitting circulation and ventilation of air through the sliding door assembly to a fully opened position for substantially permitting ingress and egress of pedestrian traffic through the sliding door assembly.

In one preferred form, a bracket is mounted to the stationary frame assembly and includes a leg having a cam-receiving portion and a wall portion which is generally spaced from and overlies portions of the slidable frame. The wall portion defines a second aperture which is positioned for alignment and registration with the first aperture of the slidable frame, preferably when the slidable door is in a partially opened position, and desirably defines a third aperture which is positioned for alignment and registration with the first aperture of the slidable frame when the slidable door is in a closed position.

In the preferred form, a key is provided with a shank for rotatable and removable insertion into the first and second apertures when the slidable door is in the partially opened position and into the first and third apertures when the slidable door is in the closed position. The key has a manually graspable head which is connected to the shank for permitting grasping of the key. Desirably, a cam is carried by and extends from the shank for interlocking engagement with the cam-receiving portion of the bracket to substantially lock the slidable door and the stationary assembly in fixed relationship to each other when the slidable door is in the closed position and in the partially opened position.

In the illustrative embodiment, the cam-receiving portion defines an inverted J-shaped channel having opposed surfaces for receiving the cam. Most preferably, the opposed surfaces are spaced from each other at a distance slightly less than the thickness of the cam for press-fitting interlocking engagement with the cam. In the illustrative embodiment, the cam is arcuate and has a generally planar surface for slidably engaging one of the opposed surfaces of the inverted J-shaped channel of the bracket and has a tapered camming surface for snugly engaging the other of the opposed surfaces of the inverted J-shaped channel.

Desirably, a grommet is placed within and circumscribed by the first aperture for resisting wear of the slidable frame and includes wedging means, such as circumferentially spaced axially extending inclined protuberances or projections, for snap-fitting engagement with the wall portion of the slidable frame defining the first aperture.

A more detailed explanation of the invention is provided in the following description and appended claims taken in conjunction with the accompanying drawings.

DETAILED DESCRIPTION OF THE ILLUSTRATIVE EMBODIMENT

Figure 1:
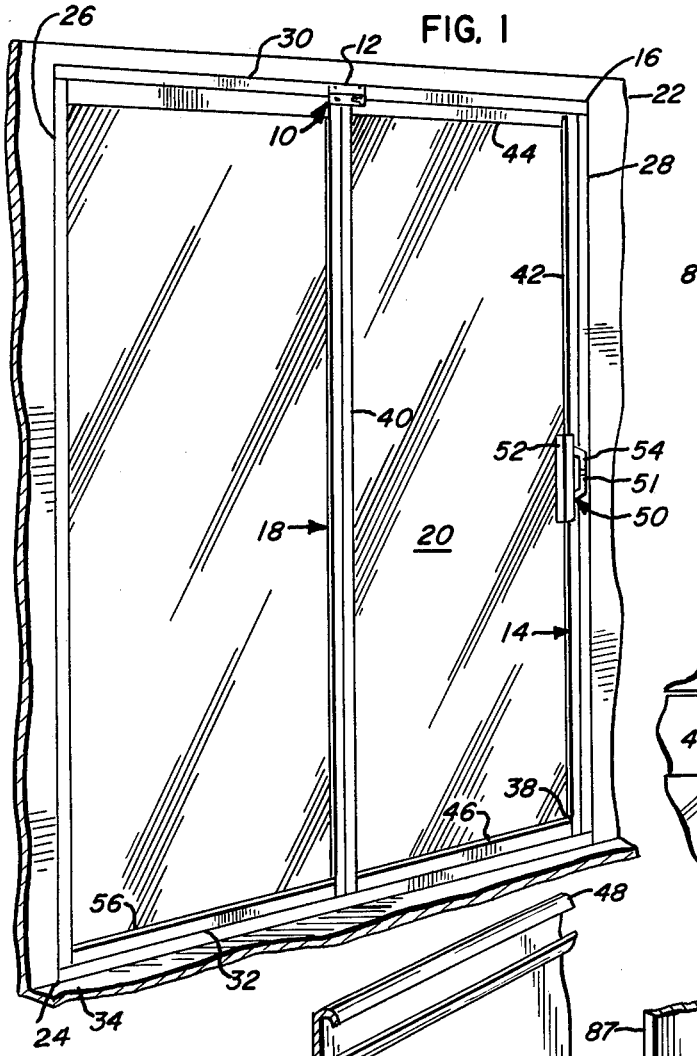
FIG. 1 is a perspective view of a sliding door locking system in accordance with principles of the present invention.
Figure 2:
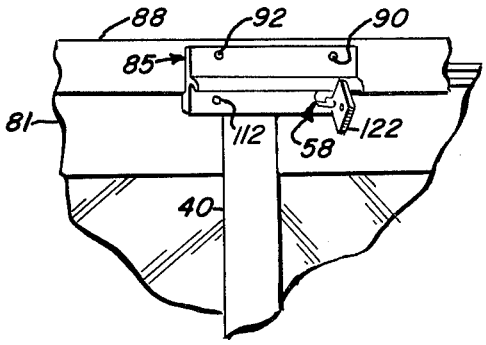
FIG. 2 is a perspective view of a security lock assembly of the present invention locking the sliding door in a closed position.
Figure 3:
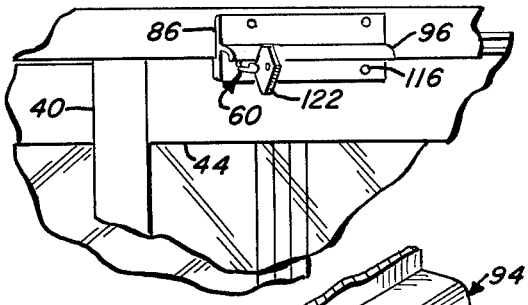
FIG. 3 is a perspective view of the security lock assembly locking the sliding door in a partially opened position.
Figure 5:
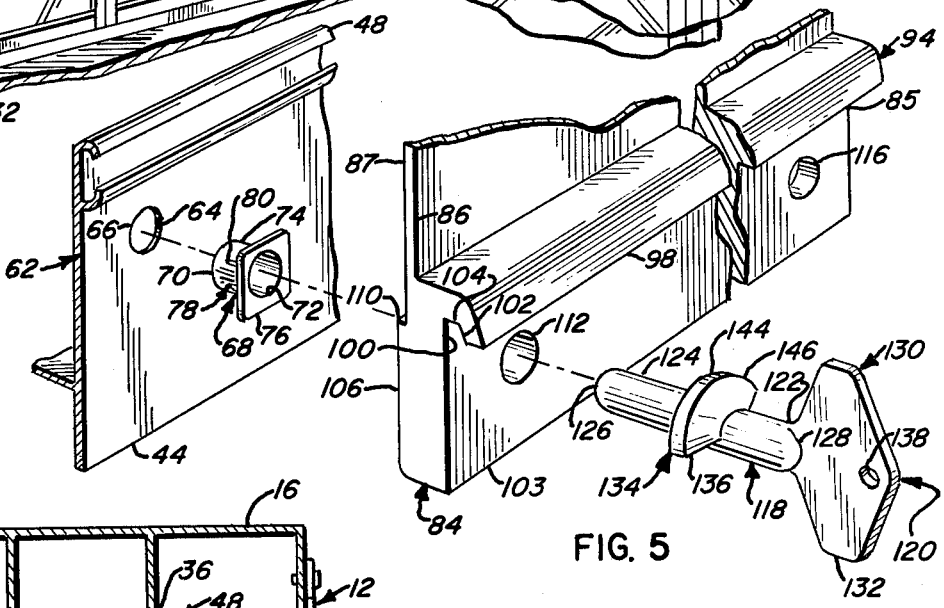
FIG. 5 is a fragmentary exploded view of the security lock assembly.
Figure 4:
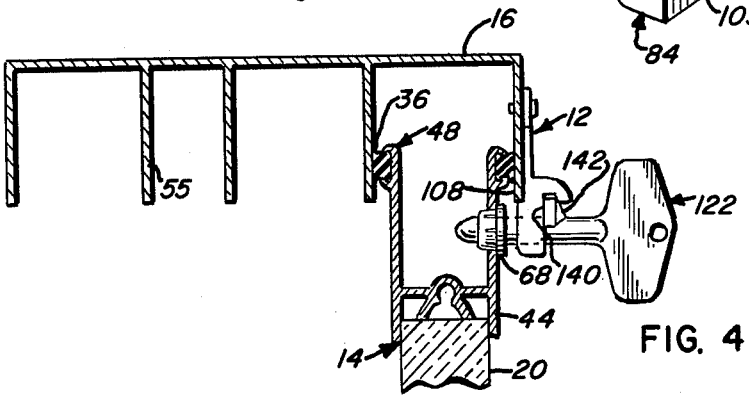
FIG. 4 is a vertical cross-sectional view of a fragmentary portion of the sliding door locking system in a locked position.

Referring to the drawings, a sliding door locking system 10 has a security lock assembly 12 for locking a slidable door 14 or panel to the stationary door frame assembly 16 of a sliding door assembly 18 or unit. While the security lock assembly 12 is particularly useful for a sliding door assembly 18 and the like, it may also be desirable in some circumstances to use the security lock assembly 12 of the present invention with other types of doors, or with windows, drawers, cabinets, or partitions or for other uses.

Sliding door assembly 18 can be installed in a room, such as a family room or other room of a house, apartment or other building, to provide a closable entrance or passageway to an outside patio, balcony, back yard or swimming pool. Such assemblies can have a slidable light-transmissive glass-like panel 20 made of glass or transparent impact-resistant plastic or the like to permit uninterrupted viewing of the area adjacent the sliding door assembly 18 both outside and inside of the building. Sliding door assembly 18 can also be used to partition one room from another in office buildings, hotels, etc., and in some circumstances, such as when the assembly 18 is used to partition one room from another room, it may be desirable that the panel be opaque or made of a substantially shatter-proof material, such as wood or plastic. In other circumstances, it may be desirable to use mirrored panels.

The stationary door frame assembly 16 of the illustrative embodiment is mounted to the wall 22 of the building and includes a rectangular door frame 24 having vertical upright sides or jambs 26 and 28, respectively, and horizontal laterally extending ends including a stationary upper frame member 30 and lower sill 32. The lower end of the sill is generally flush with the floor 34 of the building. The upper frame member 30 and lower sill 32 are provided with track means, such as upper and lower tracks 36 for slidably receiving and engaging the slidable door 14.

The slidable door 14 is generally movable or slidable along the tracks 36 of the stationary frame assembly 16 from a closed position substantially preventing passage of pedestrian traffic through the sliding door assembly 18 into the building from the outside to a partially opened position for permitting circulation and ventilation of air through sliding door assembly 18 into the building from the outside and to a fully opened position for substantially permitting ingress and egress of pedestrian traffic through the sliding door assembly 18 and vice versa. In the illustrative embodiment, the door 14 has a slidable peripheral frame 38 peripherally bounding and securing the panel 20. The slidable peripheral frame 38 generally is rectangular in shape with upright sides or stiles 40 and 42, respectively, and top and bottom horizontal rails, 44 and 46, respectively, which have mounted thereon and thus include sliding means 48, such as tandem ball bearing rollers with nylon wheel rims, for slidably engaging the tracks of the stationary frame assembly.

The closing side or stile 42 of the slidable peripheral frame 38 desirably has latching means, such as latching mechanism 50, for locking the slidable door 14 to the stationary frame assembly 16 when the door 14 is closed. Such locking mechanism 50 can include a pin or latch extending laterally from the closure jamb 28 of the stationary frame assembly 16 and a manually movable button or switch 51 mounted upon the closing stile 42. The button or switch 51 can be moved from a first position which locks the latching mechanism 50 to an open position which unlocks the latching mechanism 50. The button or switch 51 is desirably positioned on the inside face of the sliding door assembly 18 so as to permit individuals inside the household to lock the locking mechanism 50 but not permit anyone on the outside of the building, such as on the patio or in the yard, to unlock the slidable door 14. Desirably, a handle 52 is mounted, via a mounting bracket 54, upon the closing stile 42 and extends inwardly towards the room. The mounting bracket 54 generally houses the button or switch 51 for the latching mechanism. Other types of latching mechanisms can be used when desired.

Desirably, the outside channel 55 of the stationary frame assembly 16 receives a slidable screen door or panel, although in some circumstances it may be desirable that a fixed non-slidable screen be used instead of such slidable screen door. Furthermore, in cold climates and at certain seasons of the year, such as in winter, it may be desirable to use a glass storm door or panel in lieu of a screen.

In the illustrative embodiment the sliding door assembly 18 includes a stationary or dead panel 56 which is positioned between the slidable door 14 and the screen.

The sliding door locking system includes first locking means 58 for locking the slidable door 14 in a closed position and second locking means 60 for locking the slidable door 14 in a partially opened position. Both the first and second locking means 58 and 60 desirably include first wall means 62, such as an aperture-defining wall portion 64 of the top rail 44, which is integral with the slidable frame 38, and defines a first locking aperture or hole 66. In the illustrative embodiment, the first aperture 66 is close to the center stile 40 and slightly below the stationary upper frame member 30.

Preferably, a grommet 68 is disposed within and circumscribed by the first aperture 66 for resisting and reducing wear of the wall portions 64 of the slidable frame 38 adjacent the first aperture 64. The grommet 68 is desirably of impact-resistant plastic, such as an acetal homopolymer resin of the type commonly sold under the trade name of Delrin, although in some circumstances it may be desirable to use other materials, such as metal. The grommet 68 has a tubular shell 70 having an interior surface 72 and an exterior surface 74 for positioning adjacent the wall 64 of the first aperture 66. The grommet 68 also includes a face defining a generally planar rectangular-shaped mounting surface 76 at one end of the tubular shell 70. Desirably, the grommet 68 includes wedging means 78, such as, circumferentially spaced, axially extending, inclined protuberances or projections 80 extending radially outward of the tubular shell 70 for snap-fitting engagement with the wall portions 64 of the slidable frame 38 defining the first aperture 66. When installed, the mounting surface 76 is positioned against the inside face of the top rail 44.

A bracket 85 is connected to the stationary frame assembly 16. The bracket 85 has a generally planar elongated mounting plate 86 with a leg 84 extending below the mounting plate 86. The back side 87 of the mounting plate 86 is adapted to be positioned against the inside exterior surface or face 88 of stationary door frame assembly 18, such as, against the stationary upper frame member 30. In the illustrative embodiment the mounting plate 86 is provided with a pair of holes or apertures 90 into which is inserted fastening means, such as, rivets or screws 92, to fixedly secure the mounting plate 86 to the stationary door frame assembly 18. Other means can be used to fasten or secure the bracket 85 to the stationary door frame assembly 18. Desirably, bracket 85 is made out of metal, such as, aluminum, although other materials, such as, plastic, can be used.

The leg 84 of the bracket 85 has a cam-receiving portion 94, which in the illustrative embodiment, takes the form of a hook-shaped awning member or lip 96 which generally defines an inverted J-shaped channel 98 having opposed surfaces including an elongated generally planar rearward surface 100 and an inclined frontward camming surface 102 which is generally beveled or tapered toward the mounting plate 86. An upper edge or surface 104 spaces the elongated rearward surface 100 and the inclined surface 102 from each other.

The leg 84 of bracket 85 includes second wall means, such as a wall portion 103, having a front face generally defined by the elongated rearward surface 100 of the channel 98 and a back face 106 which generally faces the top rail 44 of the slidable door 14. The back face 106 is preferably flush with or positioned adjacent to the exterior back surface 108 of the stationary upper frame member 30 and is undercut to provide a shoulder or seat 110 which abuts against the lowest edge of the stationary upper frame member 30. When installed, leg 84 of bracket 85 extends downward from the stationary upper frame member 30 so as to be spaced from and overlie portions of the top rail 44 of the slidable frame 38 defining the first aperture 66.

The wall portion 103 of the leg 84 is apertured to define a second locking aperture 112 for alignment and registration with the first locking aperture 66 of the sliding frame 38 when the slidable door 14 is in a partially opened position and is apertured to define a third locking aperture 116 for registration with the first locking aperture 66 when the slidable door 14 is in a closed position. Desirably, the second and third apertures 112 and 116, respectively, are spaced from each other adjacent the respective lateral sides of the bracket 85 and are of a diameter generally equal to or slightly greater than the inside diameter of the grommet 68 defined by the interior surface 72 of the tubular shell 70. While the positioning of the bracket 85 and first, second and third apertures 66, 112 and 116, respectively, as shown in the drawings are preferred, it may be desirable in some circumstances to mount the bracket 85 along another portion of the stationary frame assembly 16, such as along jamb 28, when door 14 is positioned adjacent jamb 26, or jamb 26 or along the bottom sill 32 with the slidable frame 38 suitably apertured along stile 40 or 42 or along the bottom rail 46 for providing a first aperture adapted to be positioned in alignment and registration with the second and third apertures 112 and 116, respectively, of the bracket 85, or it may be desirable in some circumstances to form an aperture in the stationary frame assembly and mount the bracket on the slidable frame.

The security lock assembly 12 and second locking means 60 also include locking pin means 118, which can take the form of key means 120, such as locking key 122, for insertion into the first and second locking apertures 66 and 112, respectively, when the slidable door 14 is in a partially opened position for locking the slidable door 14 in the partially opened position. Desirably, the locking key 122 is of a size for insertion into the first and third locking apertures 66 and 116, respectively, when the slidable door 14 is in the closed position for locking the slidable door 14 in said closed position. Preferably, the locking key 122 is made of impact-resistant plastic, such as an acetal homopolymer resin of the type commonly sold under the trade name of Delrin, for resisting wear of the cam-receiving portion 94 of the bracket 85, although in some circumstances it may be desirable to make the locking key out of another material, such as metal.

The locking key 122 has an elongated cylindrically shaped solid shank 124 for rotatable and removable insertion into the first, second and third apertures 66, 112 and 116, respectively. The shank 124 has a rounded blunt front end or tip 126 and a rearward end 128 which is integrally connected to manually graspable head means 130, such as a generally flat expansive hexagonal-shaped winged handle 132, for grasping of the locking key 122.

Cam means or camming means 134, such as semicircular arcuate locking cam 136, is carried by and extends from the shank 124 for interlocking engagement with the cam-receiving portion 94 of the bracket 85 to substantially lock the slidable door 14 and stationary frame assembly 16 in fixed relationship to each other. The winged handle 132 extends further outward from the shank 124 than does the arcuate cam 136 so as to assist in providing the desired torque when the handle 132 is manually grasped to move the locking key 122 from a locking position to an unlocked position, and vice versa. The winged handle 132 is desirably apertured to provide a hole 138 to permit the locking key 122 to be hung on a hook or on a beaded chain.

The arcuate cam 136 generally extends radially outwardly from one portion, such as the lower portion, of the shank 124. In the illustrative embodiment, the arcuate cam 136 is spaced slightly from the middle of shank 124 toward the winged handle 132. The arcuate cam 136 has a generally flat or planar surface 140 facing toward the rounded front end 126 of the shank 124 for slidably engaging the elongated rearward surface 100 of the inverted J-shaped channel 98 of the bracket 85 and has a tapered or inclined camming surface 142 generally facing the winged handle 132 for snugly engaging the inclined frontward surface 102 of the inverted J-shaped channel 98. The tapered camming surface 142 is beveled or inclined toward the shank 124 so that the base of the arcuate cam 136 is thicker along the longitudinal length of the shank 124 than the outermost tip 144 of the cam 136. The cam 136 has a semicircular outer edge 146 which in the illustrative embodiment is spaced from the upper edge 104 of the channel 98 of the bracket 85, when the key 122 is in a locking position so as to provide a clearance between the cam 136 and the upper edge 104 of the channel 98.

Desirably, the thickness of the cam 136 defined by the distance between the tapered camming surface 142 and the planar surface 140 is slightly greater than the minimum distance between the inclined and elongated rearward surfaces 102 and 100, respectively, of the channel 98, so that the arcuate cam 136 is wedged into press-fitting interlocking engagement with opposed surfaces 100 and 102 of the channel 98 when the key 122 is rotated to a locking position, i.e., the opposed surfaces 100 and 102 of the bracket 85 are spaced from each other at a distance slightly less than the thickness of the cam 136 for press-fitting interlocking engagement with the cam 136. It is most desirable that the cam 136 be rigid but yet sufficiently flexible for repetitive press-fitting engagement to assure longer life of the cam 136 and the locking key 122.

In use, when the slidable door 14 is moved to a partially opened position, whereby the first and second apertures 66 and 112, respectively, are in alignment and registration, the slidable door 14 can be safely and securely locked to the stationary frame assembly 16 by inserting the shank 124 of the locking key 122 into the first and second apertures 66 and 112 and tubular shell 70 of the grommet 68, and subsequently manually rotating the winged handle 132 of the locking key 122 to position the locking key 122 in a locking position whereby the arcuate cam 136 wedges against and lockingly engages the inclined and elongated rearward surfaces 102 and 100, respectively, of the channel 98 of the bracket 85. Such locking secures the slidable door 14 to the stationary frame assembly 16 so as to substantially prevent the slidable door 14 from being opened by intruders when no one is in the house but yet permits the room immediately adjacent the sliding door assembly 18 to be cooled by the outside air passing through the screen. In order to open the slidable door 14 from its locked partially opened position, the winged handle 132 of the locking key 122 should be grasped and rotated to turn the cam 136 out of engagement with the channel 98 of the bracket 85, thereby moving the key 122 to an unlocked position, and subsequently removing or withdrawing the shank 124 of the key 122 from the first and second apertures, 66 and 112, respectively.

The slidable door 14 can also be safely and securely locked to the stationary frame assembly 16 when the slidable door 14 is in a closed position by inserting the shank 124 of the key 122 into the first and third apertures 66 and 116 and grommet 68 and subsequently turning the key 122 to a locked position substantially as described in relationship to locking the door 14 in a partially opened position. In order to unlock the slidable door 14 from the locked closed position, the winged handle 132 should be grasped and rotated to rotate the cam 136 from a locked position to an unlocked position and the shank 124 of the key 122 should be removed from the first and third apertures, 66 and 116, respectively.

Among the many advantages and benefits of the security lock assembly of the present invention is the provision of a simple, yet effective, assemblage, which is easily installed and which safely and securely locks sliding doors in both a partially opened position and in a closed position. The grommet, which slidably and rotatably receives the shank of the locking key, substantially resists and reduces wear of the apertured wall portion of the slidable frame and is desirably of impact-resistant plastic for resisting wear of the shank of the locking key. The locking key is desirably lightweight and of impact-resistant plastic for substantially resisting and reducing wear of the cam-receiving portion of the bracket.

Although an embodiment of this invention has been shown and described, it is to be understood that various modifications and substitutions can be made by those skilled in the art without departing from the novel spirit and scope of this invention.

What is desired to be protected and secured by Letters Patent of the United States is:

1. A security lock assembly for locking a movable panel to a stationary frame assembly, comprising:

first wall means defining a first aperture connected to said movable panel;

a bracket mounted to said stationary frame assembly including a leg having a cam-receiving portion and second wall means generally spaced from and overlying said first wall means, said second wall means defining at least one aperture positioned for alignment and registration with said first aperture; and key means having a shank for rotatable and removable insertion into both said first aperture and said one aperture when said first aperture and said one aperture are in alignment and registration, manually graspable head means connected to said shank for permitting grasping of said key means, and cam means carried by and extending from said shank for interlocking engagement with said cam-receiving portion of said bracket to substantially lock said movable panel and said stationary frame assembly in fixed relationship to each other.

2. A sliding door locking system, comprising:

a slidable door having a light-transmissive glass-like panel and a slidable frame peripherally bounding and securing said light-transmissive glass-like panel, said slidable frame including first wall means defining a first locking aperture;

a stationary frame assembly having track means for slidably receiving and engaging said slidable frame for accommodating sliding movement of said slidable door from a closed position to a partially opened position to a fully opened position;

a bracket mounted to said stationary frame assembly including a leg having a cam-receiving portion and second wall means generally spaced from and overlying said slidable frame, said cam-receiving portion defining an inverted J-shaped channel having an elongated rearward surface and an inclined frontward surface spaced from said elongated rearward surface, said second wall means being integral with said elongated rearward surface defining a second locking aperture positioned for alignment and registration with the first locking aperture when said slidable door is in said partially opened position and defining a third locking aperture spaced from said second locking aperture and positioned for alignment and registration with said first locking aperture when said slidable door is in said closed position;

fastening means for securing said bracket to said stationary frame assembly;

a grommet disposed within and circumscribed by said first aperture for resisting wear of said frame member and having wedging means for snap-fitting engagement with said first wall means of said slidable frame defining said first aperture; and key means having a shank for rotatable and removable insertion into said first, second and third apertures, manually graspable head means connected to said shank for permitting grasping of said key means, and cam means carried by and extending from said shank for interlocking engagement with said cam-receiving portion to substantially lock said slidable door and said stationary frame assembly in fixed relationship to each other in said closed position and in said partially opened position, said cam means including a semicircular arcuate cam having a generally planar surface for slidably engaging said elongated rearward surface of said inverted J-shaped channel and a tapered camming surface for snugly engaging said inclined frontward surface of said inverted J-shaped channel.

3. A sliding door locking system in accordance with claim 2 wherein:

said grommet is of impact-resistant plastic for resisting wear of said shank; and said cam means is of a thickness slightly greater than the minimum distance between said elongated rearward surface and said inclined frontward surface for press-fitting interlocking engagement with said inverted J-shaped channel and is of impact-resistant plastic for resisting wear of said cam-receiving portion of said bracket.

4. A sliding door locking system, comprising:

a slidable door having a panel and a slidable frame securing said panel, said slidable frame having first wall means defining a first aperture;

a stationary frame assembly having track means for slidably receiving and engaging said slidable frame of said slidable door;

a bracket mounted to said stationary frame assembly including a leg having a cam-receiving portion and second wall means generally spaced from and overlying portions of said slidable frame, said second wall means defining at least one aperture positioned for alignment and registration with said first aperture; and key means having a shank for rotatable and removable insertion into both said first aperture and said one aperture when said first aperture and said one aperture are in alignment and registration, manually graspable head means connected to said shank for permitting grasping of said key means, and cam means carried by and extending from said shank for interlocking engagement with said cam-receiving portion of said bracket to substantially lock said slidable door and said stationary frame assembly in fixed relationship to each other.

5. A sliding door locking system in accordance with claim 4 wherein said cam-receiving portion defines an inverted J-shaped channel having opposed surfaces for receiving said cam means.

6. A sliding door locking system in accordance with claim 5 wherein said opposed surfaces are spaced from each other at a distance slightly less than the thickness of the cam means for press-fitting interlocking engagement with said cam means.

7. A sliding door locking system in accordance with claim 4 wherein said second wall means of said bracket defines another aperture for alignment and registration with said first aperture, said another aperture being spaced from said one aperture of said bracket and being of a size for removably and rotatably receiving said shank of said key means.

8. A sliding door locking system in accordance with claim 4 further including a grommet disposed within and circumscribed by said first aperture for resisting wear of said first wall means of said slidable frame and for slidably and rotatably receiving said shank.

9. A sliding door locking system in accordance with claim 8 wherein said grommet includes wedging means for snap-fitting engagement with said first wall means of said slidable frame defining said first aperture.

10. A sliding door locking system in accordance with claim 9 wherein said grommet is of impact-resistant plastic for resisting wear of said shank.

11. A sliding door locking system in accordance with claim 5 wherein said cam means includes an arcuate cam having a generally planar surface for slidably engaging one of said opposed surfaces of said inverted J-shaped channel of said bracket and a tapered camming surface for snugly engaging the other of said opposed surfaces of said inverted J-shaped channel.

* * * * *